US011371414B2

(12) United States Patent
Oso et al.

(10) Patent No.: US 11,371,414 B2
(45) Date of Patent: Jun. 28, 2022

(54) EXHAUST SYSTEM FOR ENGINE

(71) Applicant: KUBOTA Corporation, Osaka (JP)

(72) Inventors: Hiroki Oso, Sakai (JP); Nobuyoshi Okada, Sakai (JP); Hideyuki Koyama, Sakai (JP); Yoshinori Tanaka, Sakai (JP); Kenji Okamoto, Sakai (JP)

(73) Assignee: KUBOTA CORPORATION, Osaka (JP)

( * ) Notice: Subject to any disclaimer, the term of this patent is extended or adjusted under 35 U.S.C. 154(b) by 0 days.

(21) Appl. No.: 16/857,245

(22) Filed: Apr. 24, 2020

(65) Prior Publication Data

US 2020/0340388 A1 Oct. 29, 2020

(30) Foreign Application Priority Data

Apr. 26, 2019 (JP) ..... JP2019-085480
Sep. 26, 2019 (JP) ..... JP2019-175020

(51) Int. Cl.
*F01N 13/16* (2010.01)
*F01N 13/10* (2010.01)
(Continued)

(52) U.S. Cl.
CPC ..... *F01N 13/16* (2013.01); *F01N 13/10* (2013.01); *F01N 13/1805* (2013.01); *F02B 37/02* (2013.01); *F01N 2530/02* (2013.01)

(58) Field of Classification Search
CPC ..... F01N 13/16; F01N 13/10; F01N 13/1805; F01N 2530/02; F01N 2510/08;
(Continued)

(56) References Cited

U.S. PATENT DOCUMENTS 4,881,983 A * 11/1989 Smith ..... C23C 8/80 148/217
2008/0012296 A1 1/2008 Johnston et al.
(Continued)

FOREIGN PATENT DOCUMENTS

JP H0639582 B2 5/1994
WO 03087648 A1 10/2003

OTHER PUBLICATIONS

Video entitled EIMA2018 : Discover the new Kubota engine D902-T-E4 !—Kubota (kubota-eu.com), found at https://kuk.kubota-eu.com/blog/news/eima2018-discover-the-new-kubota-engine-d902-t-e4/#agriculture. Nov. 2018.*
(Continued)

*Primary Examiner* — Mark A Laurenzi
*Assistant Examiner* — Mickey H France
(74) *Attorney, Agent, or Firm* — Panitch Schwarze Belisario & Nadel LLP

(57) ABSTRACT

Provided is an exhaust system for an engine in which a fastening force of a fastener hardly decreases. An exhaust system for an engine includes: an exhaust passage component of ferrous metal; and a fastener that fastens the exhaust passage component to other parts, the exhaust passage component including a pressure receiving surface that receives a fastening force of the fastener. The oxide film of triiron tetraoxide is formed on the pressure receiving surface of the exhaust passage component. It is preferable that the oxide film of triiron tetraoxide be also formed on an outer surface other than the pressure receiving surface of the exhaust passage component. It is preferable that the oxide film of triiron tetraoxide be also formed on an inner surface of the exhaust passage component.

10 Claims, 5 Drawing Sheets

(51) Int. Cl.
*F01N 13/18* (2010.01)
*F02B 37/02* (2006.01)

(58) Field of Classification Search
CPC .. F01N 13/1855; F01N 13/1861; F01N 13/08; F02B 37/02; F02B 67/10; F02B 37/00
See application file for complete search history.

(56) References Cited

U.S. PATENT DOCUMENTS

| | | | | |
|---|---|---|---|---|
| 2009/0064670 | A1* | 3/2009 | Kimura | F01N 13/10 60/323 |
| 2010/0170235 | A1* | 7/2010 | Vannoy | F01N 13/082 60/324 |
| 2011/0277466 | A1* | 11/2011 | Danielewicz | F01N 13/1805 60/598 |
| 2013/0061586 | A1* | 3/2013 | Demots | F01N 13/1811 60/323 |
| 2014/0060983 | A1* | 3/2014 | Sugai | F16D 65/127 188/218 XL |
| 2016/0115950 | A1 | 4/2016 | Ikeda et al. | |
| 2016/0339545 | A1* | 11/2016 | Sordelet | C23C 4/02 |

OTHER PUBLICATIONS

Extended European Search Report dated Jun. 12, 2020 in European Application No. 20166449.7.

* cited by examiner

TOP
BOTTOM
FRONT
REAR
ONE LATERAL SIDE
THE OTHER LATERAL SIDE

EXHAUST SYSTEM FOR ENGINE

CROSS-REFERENCE TO RELATED APPLICATION

This application claims priority under 35 U.S.C. § 119(b) to Japanese Application No. 2019-085480 filed Apr. 26, 2019, and Japanese Application No. 2019-175020 filed Sep. 26, 2019, the disclosures of which are incorporated by reference herein in their entirety.

BACKGROUND OF THE INVENTION

(1) Field of the Invention

The present invention relates to an exhaust system for an engine.

(2) Description of Related Art

In a conventional exhaust system for an engine, the generation of red rust due to exhaust heat in the exhaust passage component can be prevented by a rustproof resin film. However, in a case where the exhaust passage component is fastened to other parts, when the pressure receiving surface that receives the fastening force of the fastener is covered with the rustproof resin film, the plastic deformation of the rustproof resin film may greatly reduce the fastening force of the fastener.

SUMMARY OF THE INVENTION

An object of the present invention is to provide an exhaust system for an engine in which a fastening force of a fastener hardly decreases.

In the present invention, an oxide film of triiron tetraoxide is formed on a pressure receiving surface of an exhaust passage component.

According to the present invention, a fastening force of a fastener (2) is less likely to decrease. Further, the generation of red rust due to exhaust heat on a pressure receiving surface (1*a*) of an exhaust passage component (1) is prevented.

BRIEF DESCRIPTION OF THE DRAWINGS

FIG. 1A is a side view of the main part of the engine, FIG. 1B is an enlarged cross-sectional view taken along line B-B of FIG. 1A, FIG. 1C is an enlarged cross-sectional view taken along line C-C of FIG. 1A, FIG. 1D is an enlarged cross-sectional view taken along line D-D of FIG. 1A, FIG. 1E is an enlarged cross-sectional view taken along line E-E of FIG. 1A, and FIG. 1F is an enlarged cross-sectional view taken along line F-F of FIG. 1A;

FIG. 4A is a side view, FIG. 4B is a view in the direction of arrow B in FIG. 4A, FIG. 4C is a view in the direction of arrow C in FIG. 4A, FIG. 4D is a view in the direction of arrow D in FIG. 4A, and FIG. 4E is a view in the direction of arrow E in FIG. 4C; FIG. 5A is a side view, FIG. 5B is a view in the direction of arrow B in FIG. 5A, FIG. 5C is a view in the direction of arrow C in FIG. 5A, FIG. 5D is a view in the direction of arrow D in FIG. 5A, and FIG. 5E is a view in the direction of arrow E in FIG. 5D.

DETAILED DESCRIPTION OF PREFERRED EMBODIMENT

FIGS. 1A to 1F to FIGS. 5A to 5E are views illustrating an engine provided with an exhaust system according to an embodiment of the present invention.

In this embodiment, a vertical water-cooled in-line multi-cylinder diesel engine will be described.

Figure 2:
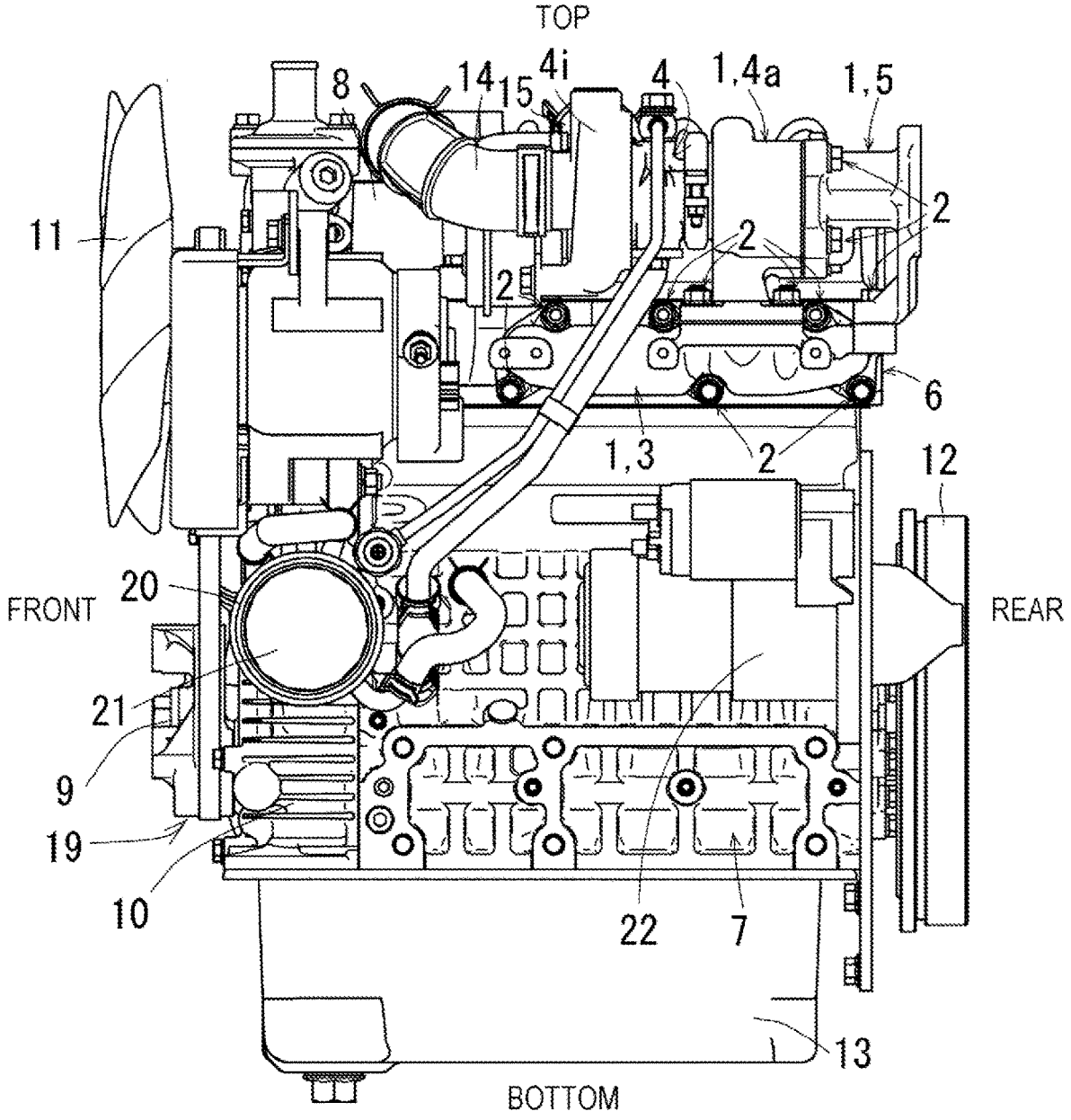
FIG. 2 is a side view of the engine of FIGS. 1A to 1F.
Figure 3:
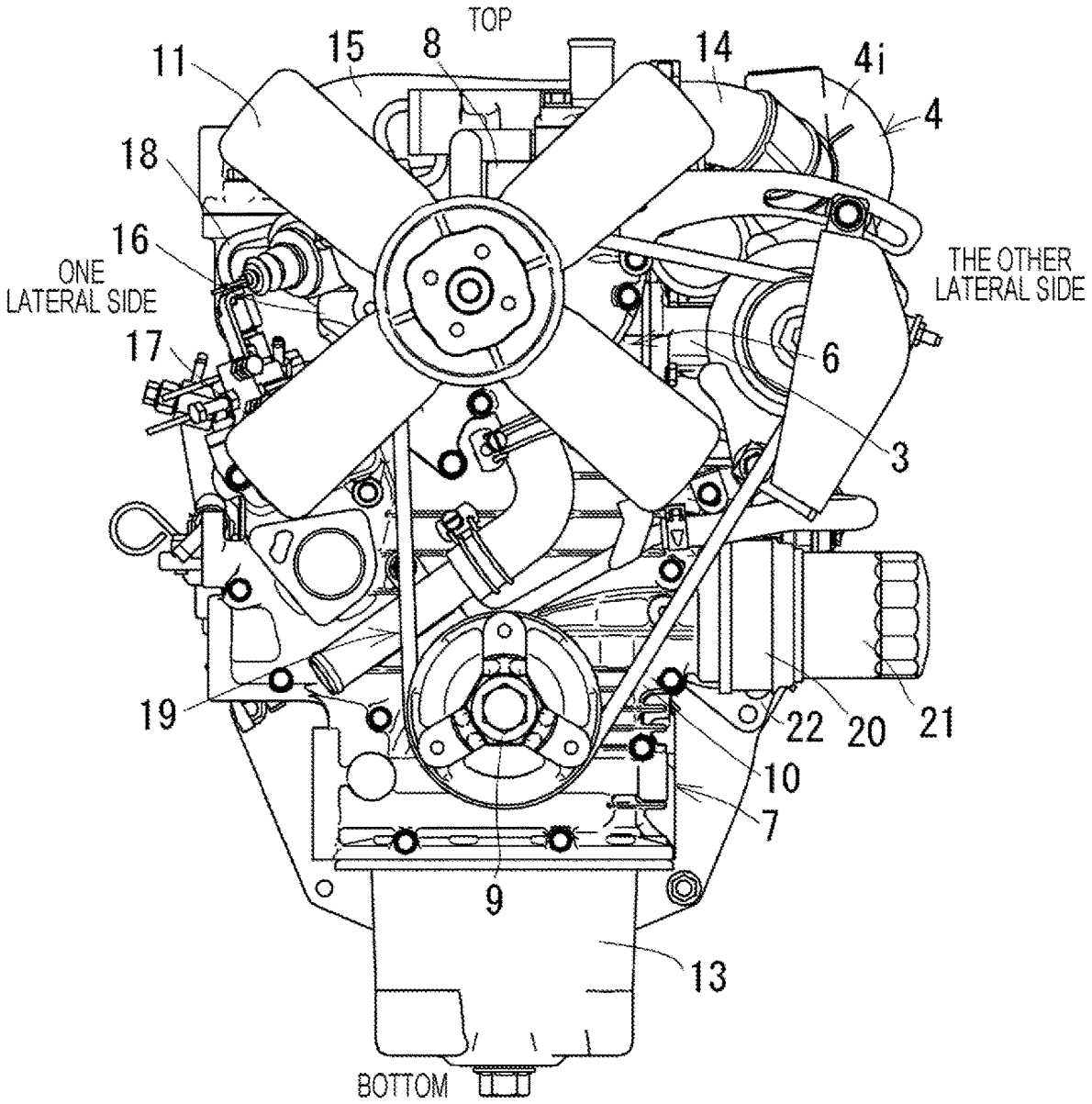
FIG. 3 is a front view of the engine of FIGS. 1A to 1F.

As illustrated in FIGS. 2 and 3, this engine includes a cylinder block (7), a cylinder head (6) assembled to the top of the cylinder block (7), a cylinder head cover (8) assembled to the top of the cylinder head (6), a front cover (10) assembled to the front of the cylinder block (7) with the installation direction of a crankshaft (9) taken as the front-rear direction, an engine cooling fan (11) disposed ahead of the cylinder head (6), a flywheel (12) disposed behind the cylinder block (7), and an oil pan (13) assembled to a lower portion of the cylinder block (7).

The crankshaft (9) is cranked by a starter motor (22). The engine cooling fan (11) is driven from the crankshaft (9) via a belt transmission (19). An oil filter (21) is attached to the front cover (10) via an oil cooler (20).

This engine includes an intake system, a fuel supply device, and an exhaust system.

As illustrated in FIGS. 2 and 3, the intake system includes an intake pipe (14), an air compressor housing (4*i*) of a supercharger (4), a supercharge pipe (15), and an intake manifold (16), and intake air is supplied to a cylinder (not illustrated) in the cylinder block (7). A compressor wheel (not illustrated) is housed in the air compressor housing (4*i*). The intake manifold (16) is disposed on one lateral side of the cylinder head (6) as illustrated in FIG. 3, with the width direction of the engine orthogonal to the front-rear direction taken as the lateral direction.

As illustrated in FIG. 3, the fuel supply device is disposed on one lateral side of the engine in which the intake manifold (16) is disposed. The fuel supply device includes a fuel injection pump (17), a fuel injection pipe (18), and a fuel injection valve (not illustrated) to supply fuel to the cylinder.

As illustrated in FIG. 2, the exhaust system includes an exhaust manifold (3), an exhaust turbine housing (4*a*) of the supercharger (4), and an exhaust relay pipe (5), and discharges exhaust gas from a cylinder. A turbine wheel (not illustrated) is housed in the exhaust turbine housing (4*a*). As illustrated in FIG. 3, the exhaust manifold (3) is attached to the other lateral side of the cylinder head (6) opposite to the one lateral side where the intake manifold (16) is disposed.

An exhaust muffler or an exhaust duct is connected to the exhaust downstream side of the exhaust relay pipe (5) illustrated in FIG. 2, but an exhaust after-treatment device (not illustrated) may be connected. In the exhaust after-treatment device, diesel oxidation catalysts (DOC) are housed on the exhaust upstream side in a post-treatment case, and diesel particulate filters (DPF) are housed on the exhaust downstream side. DOC is an abbreviation for diesel oxidation catalyst, and DPF is an abbreviation for diesel particulate filter.

As illustrated in FIGS. 1B to 1F, FIGS. 4A to 4E, and FIGS. 5A to 5E, the exhaust system includes an exhaust passage component (1) of ferrous metal, and a fastener (2) for fastening the exhaust passage component (1) to other parts. The exhaust passage component (1) includes a pressure receiving surface (1*a*) that receives a fastening force of the fastener (2).

A specific example of the exhaust passage component (1) will be described later.

As illustrated in FIGS. 1B to 1F, an oxide film (1*b*) of triiron tetraoxide is formed on the pressure receiving surface (1*a*) of the exhaust passage component (1).

Hence, the exhaust system has the following effects.

That is, as compared to the rustproof resin film, the oxide film (1*b*) of triiron tetraoxide is less likely to be plastically deformed, and the fastening force of the fastener (2) is less likely to decrease.

Further, the rustproof action of the oxide film (1*b*) of triiron tetraoxide prevents the generation of red rust due to exhaust heat on the pressure receiving surface (1*a*) of the exhaust passage component (1).

As illustrated in FIGS. 1B to 1F, 4A, and 5A, the oxide film (1*b*) of triiron tetraoxide is also formed on the outer surface (1*c*) other than the pressure receiving surface (1*a*) of the exhaust passage component (1).

Hence, the exhaust system has the following effects.

That is, as compared to the rustproof resin film, the oxide film (1*b*) of triiron tetraoxide has excellent heat resistance, and hardly causes cracking or discoloration on the outer surface (1*c*) of the exhaust passage component (1).

Further, the oxide film (1*b*) of triiron tetraoxide prevents the generation of red rust due to exhaust heat on the outer surface (1*c*) of the exhaust passage component (1) excluding the pressure receiving surface (1*a*).

As illustrated in FIGS. 4A, 4B, 4E and FIGS. 5B to 5D, the oxide film (1*b*) of triiron tetraoxide is also formed on the inner surface (1*d*) of the exhaust passage component (1).

Hence, the exhaust system has the following effects.

That is, the oxide film (1*b*) of triiron tetraoxide also prevents the generation of red rust due to exhaust heat on the inner surface (1*d*) of the exhaust passage component (1).

In this embodiment, as illustrated in FIGS. 1A, 2, and 4A to 4E, a first specific example of the exhaust passage component (1) is an exhaust manifold (3).

Hence, the exhaust system has the following effects.

Figures 1A, 1B, 1C, 1D, 1E, 1F:
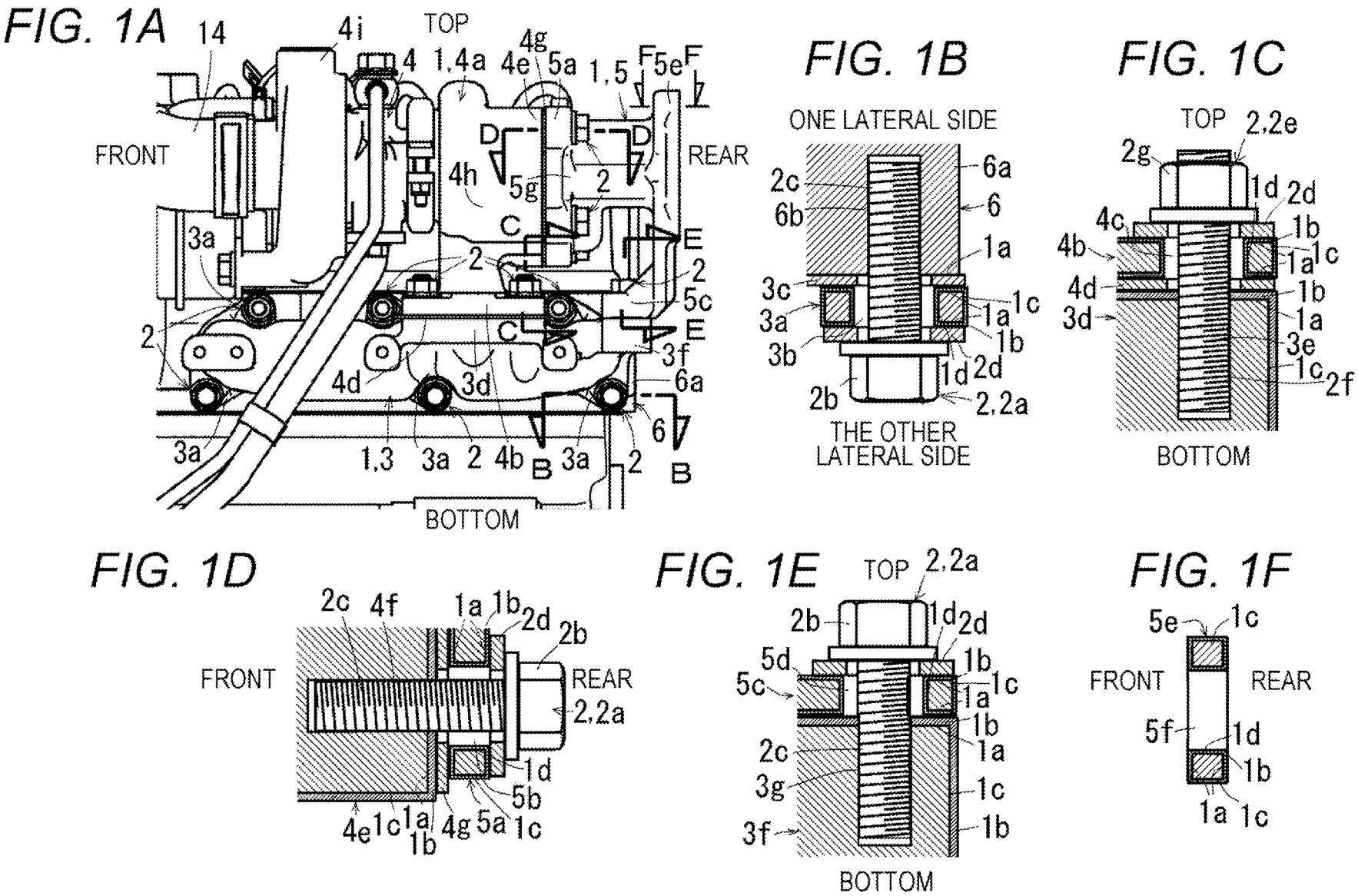
FIGS. 1A to 1F are views for explaining a main part of an engine according to an embodiment of the present invention.

That is, since the fastening force of the fastener (2) received on the pressure receiving surface (1*a*) of the exhaust manifold (3) illustrated in FIGS. 1B, 1D, and 1E hardly decreases, the tightness between the exhaust manifold (3) fastened by the fastener (2) and other parts (the cylinder head (6), the exhaust turbine housing (4*a*) of the supercharger (4), and the exhaust relay pipe (5)) can be maintained high.

As illustrated in FIG. 1B, the pressure receiving surface (1*a*) of the exhaust manifold (3) is formed on each of the front and back surfaces of the exhaust inlet flange (3*a*). The exhaust inlet flange (3*a*) is fastened to the side wall (6*a*) of the cylinder head (6) with the fastener (2).

This fastener (2) is a headed bolt (2*a*) and includes a bolt head (2*b*) and a male screw (2*c*). The male screw (2*c*) passes through a bolt insertion hole (3*b*) of the exhaust inlet flange (3*a*) and is screw-fitted into a female screw hole (6*b*) of the side wall (6*a*) of the cylinder head (6). The exhaust inlet flange (3*a*) is sandwiched between the bolt head (2*b*) and the cylinder head (6) together with a washer (2*d*) and a first gasket (3*c*), and a fastening force of the headed bolt (2*a*) is applied to the pressure receiving surface (1*a*) formed on each of the front and back surfaces of the exhaust inlet flange (3*a*).

The oxide film (1*b*) of triiron tetraoxide is formed on the pressure receiving surface (1*a*).

As illustrated in FIG. 1C, the pressure receiving surface (1*a*) of the exhaust manifold (3) is also formed on the upper surface of the exhaust outlet flange (3*d*). An exhaust inlet flange (4*b*) of an exhaust turbine housing (4*a*) of the supercharger (4) is fastened to the exhaust outlet flange (3*d*) with the fastener (2).

The fastener (2) is a stud bolt and nut (2*e*) and includes a stud bolt (2*f*) and a nut (2*g*). The stud bolt (2*f*) is screw-fitted into a female hole (3*e*) of the exhaust outlet flange (3*d*) of the exhaust manifold (3). The stud bolt (2*f*) penetrates a bolt insertion hole (4*c*) of the exhaust inlet flange (4*b*) of the exhaust turbine housing (4*a*) in the supercharger (4), and the nut (2*g*) is screw-fitted to this stud bolt (2*f*). The exhaust inlet flange (4*b*) of the exhaust turbine housing (4*a*) is sandwiched between the exhaust outlet flange (3*d*) of the exhaust manifold (3) and the nut (2*g*) together with the washer (2*d*) and a second gasket (4*d*). A fastening force of the stud bolt and nut (2*e*) is applied to the pressure receiving surface (1*a*) formed on the upper surface of the exhaust outlet flange (3*d*) of the exhaust manifold (3).

The oxide film (1*b*) of triiron tetraoxide is also formed on the pressure receiving surface (1*a*).

In this embodiment, as illustrated in FIGS. 1A and 2, a second specific example of the exhaust passage component (1) is an exhaust turbine housing (4*a*) of the supercharger (4).

Hence, the exhaust system has the following effects.

That is, the fastening force of the fastener (2) received on the pressure receiving surface (1*a*) of the exhaust turbine housing (4*a*) illustrated in FIGS. 1C and 1D hardly decreases, so that the sealing performance is kept high between the exhaust turbine housing (4*a*) of the supercharger (4) and other parts (the exhaust manifold (3) or the exhaust relay pipe (5)), which are fastened by the fastener (2).

As illustrated in FIG. 1C, the pressure receiving surface (1*a*) of the exhaust turbine housing (4*a*) is formed on each of the upper and lower surfaces and on each of the vertical front and back surfaces of the exhaust inlet flange (4*b*). As described above, the exhaust inlet flange (4*b*) is fastened to the exhaust outlet flange (3*d*) of the exhaust manifold (3) with the stud bolt and nut (2*e*).

Therefore, the fastening force of the stud bolt and nut (2*e*) is applied to the pressure receiving surface (1*a*) formed on each of the upper and lower surfaces and the vertical front and back surfaces of the exhaust inlet flange (4*b*) of the exhaust turbine housing (4*a*).

The oxide film (1*b*) of triiron tetraoxide is formed on the pressure receiving surface (1*a*).

As illustrated in FIG. 1D, the pressure receiving surface (1*a*) of the exhaust turbine housing (4*a*) is also formed on the rear surface of the exhaust outlet (4*e*). An exhaust inlet flange (5*a*) of the exhaust relay pipe (5) is fastened to the exhaust outlet (4*e*) of the exhaust turbine housing (4*a*) with the fastener (2).

This fastener (2) is a headed bolt (2*a*) and includes the bolt head (2*b*) and the male screw (2*c*). The male screw (2*c*) passes through the bolt insertion hole (5*b*) of the exhaust inlet flange (5*a*) of the exhaust relay pipe (5) and is screw-fitted into a female screw hole (4*f*) of the exhaust outlet (4*e*) of the exhaust turbine housing (4*a*). The exhaust inlet flange (5*a*) of the exhaust relay pipe (5) is sandwiched between the bolt head (2*b*) and the exhaust outlet (4*e*) of the exhaust turbine housing (4*a*) together with the washer (2*d*) and a third gasket (4*g*). The fastening force of the headed bolt (2*a*)

is applied to the pressure receiving surface (1*a*) formed on the rear surface of the exhaust outlet (4*e*) of the exhaust turbine housing (4*a*).

The oxide film (1*b*) of triiron tetraoxide is also formed on the pressure receiving surface (1*a*).

In this embodiment, as illustrated in FIGS. 1A and 2, a third specific example of the exhaust passage component (1) is an exhaust relay pipe (5).

Hence, the exhaust system has the following effects.

That is, the fastening force of the fastener (2) received on the pressure receiving surface (1*a*) of the exhaust relay pipe (5) illustrated in FIGS. 1D to 1F hardly decreases, so that the sealing performance is kept high between the exhaust relay pipe (5) and other parts (the exhaust turbine housing (4*a*), the exhaust manifold (3), an exhaust muffler, the exhaust duct, or an exhaust after-treatment case), which are fastened by the fastener (2).

As illustrated in FIG. 1D, the pressure receiving surface (1*a*) of the exhaust relay pipe (5) is formed on each of the front and back surfaces in the front-rear direction of the exhaust inlet flange (5*a*). As described above, the exhaust inlet flange (5*a*) of the exhaust relay pipe (5) is fastened to the exhaust outlet (4*e*) of the exhaust turbine housing (4*a*) with the headed bolt (2*a*).

Therefore, the fastening force of the headed bolt (2*a*) is applied to the pressure receiving surface (1*a*) formed on each of the front and back surfaces in the front-rear direction of the exhaust inlet flange (5*a*) of the exhaust relay pipe (5).

The oxide film (1*b*) of triiron tetraoxide is also formed on the pressure receiving surface (1*a*).

As illustrated in FIG. 1E, the pressure receiving surface (1*a*) of the exhaust relay pipe (5) is also formed on each of the vertical front and back surfaces of a mounting flange (5*c*).

The mounting flange (5*c*) of the exhaust relay pipe (5) is fastened to the upper surface of the mounting seat (3*f*) disposed on the upper side of the exhaust manifold (3) with the fastener (2).

This fastener (2) is a headed bolt (2*a*) and includes the bolt head (2*b*) and the male screw (2*c*). The male screw (2*c*) passes through a bolt insertion hole (5*d*) of the mounting flange (5*c*) of the exhaust relay pipe (5) and is screw-fitted into a female screw hole (3*g*) of a mounting seat (3*f*) of the exhaust manifold (3). The mounting flange (5*c*) of the exhaust relay pipe (5) is sandwiched between the bolt head (2*b*) and the mounting seat (3*f*) of the exhaust manifold (3) together with the washer (2*d*). The fastening force of the headed bolt (2*a*) is applied to the pressure receiving surface (1*a*) formed on the upper surface of the mounting seat (3*f*) of the exhaust manifold (3).

The oxide film (1*b*) of triiron tetraoxide is also formed on the pressure receiving surface (1*a*).

As illustrated in FIG. 1F, the pressure receiving surface (1*a*) of the exhaust relay pipe (5) is also formed on each of the front and back surfaces in the front-rear direction of an exhaust outlet flange (5*e*). To the exhaust outlet flange (5*e*), the exhaust inlet flange of the exhaust after-treatment case is fastened with a fastener (not illustrated, but a bolt and nut is used) passing through the bolt insertion hole (5*f*) of the exhaust outlet flange (5*e*).

Thus, the fastening force of the fastener is applied to the pressure receiving surface (1*a*) formed on each of the front and back surfaces in the front-rear direction of the exhaust outlet flange (5*e*) of the exhaust relay pipe (5).

The oxide film (1*b*) of triiron tetraoxide is also formed on the pressure receiving surface (1*a*).

As illustrated in FIGS. 4A to 4E, the exhaust manifold (3) includes a collector (3*h*) that is long in the front-rear direction, a plurality of exhaust inlet flanges (3*a*) arranged on one lateral side of the collector (3*h*), a single exhaust outlet flange (3*d*) disposed above the collector (3*h*), and the mounting seat (3*f*) disposed above the rear of the collector (3*h*). The oxide film (1*b*) of triiron tetraoxide is also formed on the outer surface (1*c*) other than the pressure receiving surface (1*a*) of each of these sections.

Figure 4B:
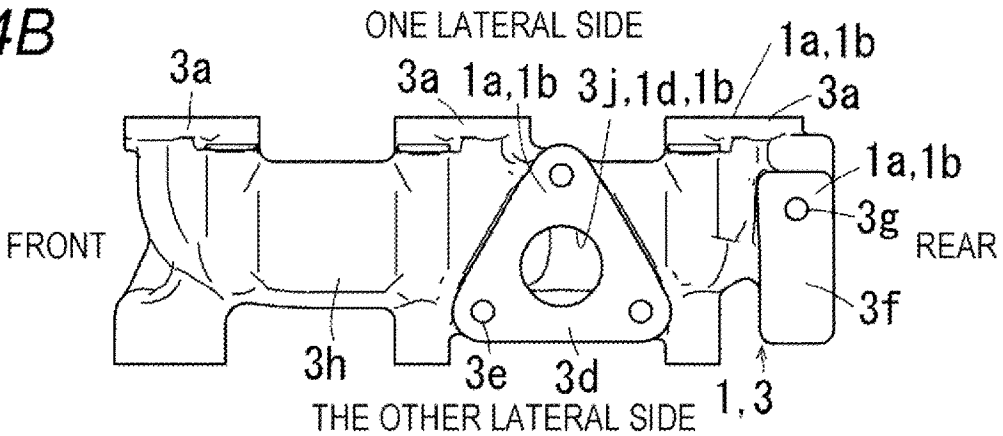
FIGS. 4A to 4E are views for explaining an exhaust manifold used in the engine of FIGS. 1A to 1F.
Figure 4A:
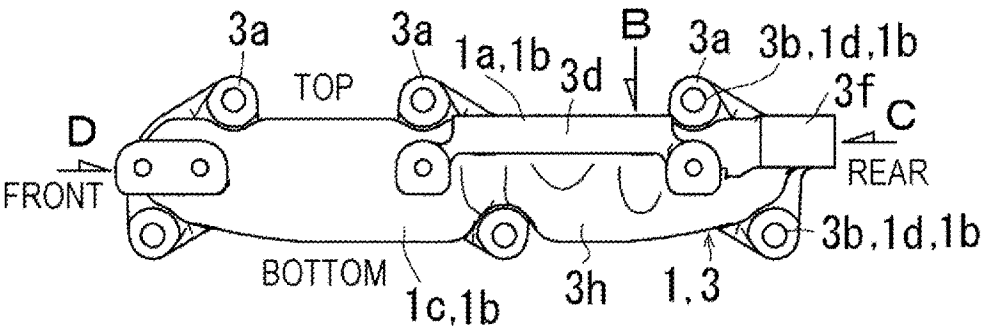
Figure 4C:
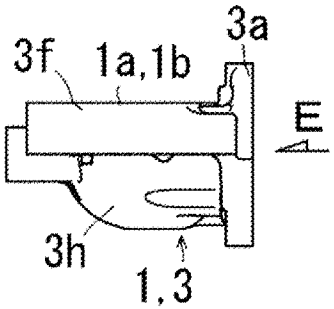
Figure 4D:
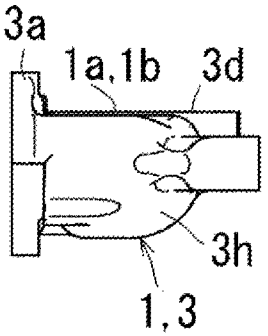
Figure 4E:
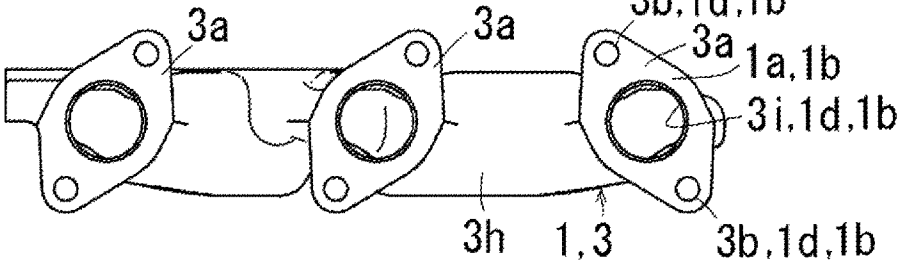

The oxide film (1*b*) of triiron tetraoxide is also formed on each of the inner surfaces (1*d*) of the exhaust passage inside the collector (3*h*), the bolt insertion hole (3*b*) of the exhaust inlet flange (3*a*) illustrated in FIG. 4A, and an exhaust outlet (3*j*) of the exhaust outlet flange (3*d*) illustrated in FIG. 4B.

As illustrated in FIG. 1A, the exhaust turbine housing (4*a*) of the supercharger (4) includes a housing body (4*h*), an exhaust inlet flange (4*b*) disposed below the housing body (4*h*), and the exhaust outlet (4*e*) disposed behind the housing body (4*h*). The oxide film (1*b*) of triiron tetraoxide is also formed on the outer surface (1*c*) other than the pressure receiving surface (1*a*) of each of these sections.

The oxide film (1*b*) of triiron tetraoxide is also formed on each of the inner surfaces (1*d*) of the exhaust passage of the housing body (4*h*), an exhaust inlet (not illustrated) of the exhaust inlet flange (4*b*), and the exhaust outlet (not illustrated) of the exhaust outlet (4*e*).

As illustrated in FIGS. 5A to 5E, the exhaust relay pipe (5) includes a pipe (5*g*), the exhaust inlet flange (5*a*) disposed ahead of the pipe (5*g*), the exhaust outlet flange (5*e*) disposed behind the pipe (5*g*), and the mounting flange (5*c*) disposed below the exhaust outlet flange (5*e*). The oxide film (1*b*) of triiron tetraoxide is also formed on the outer surface (1*c*) other than the pressure receiving surface (1*a*) of each of these sections.

Figure 5B:
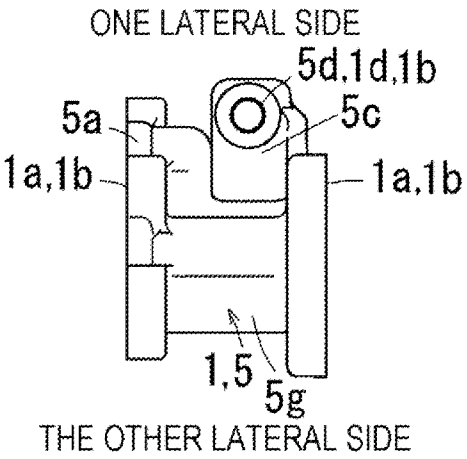
FIGS. 5A to 5E are views for explaining an exhaust relay pipe used in the engine of FIGS. 1A to 1F.
Figure 5A:
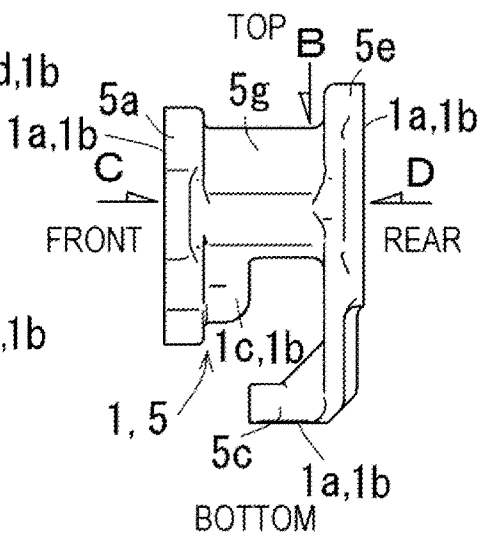
Figure 5C:
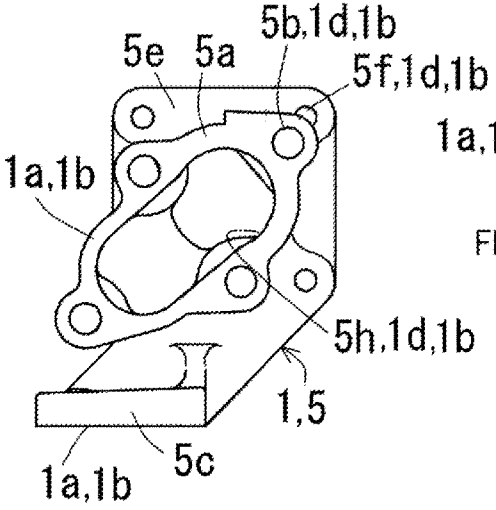
Figure 5D:
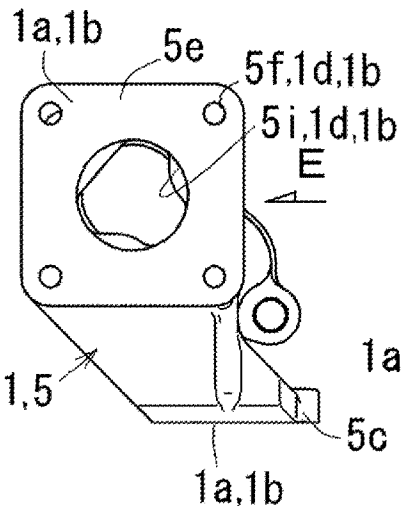
Figure 5E:
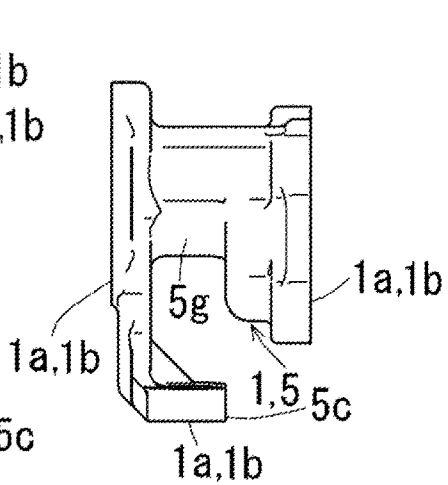

The oxide film (1*b*) of triiron tetraoxide is also formed on each of the inner surfaces (1*d*) of the exhaust passage inside the pipe (5*g*), the bolt insertion hole (5*d*) of the mounting flange (5*c*) illustrated in FIG. 5B, the bolt insertion hole (5*b*) and a discharge inlet (5*h*) of the exhaust inlet flange (5*a*) illustrated in FIG. 5C, and an exhaust outlet (5*i*) of the exhaust outlet flange (5*e*) and the bolt insertion hole (5*f*) illustrated in FIG. 5D.

The oxide film (1*b*) of triiron tetraoxide preferably has a thickness of 5 μm to 11 μm.

In this case, the following effects can be obtained.

When the thickness of the oxide film (1*b*) is less than 5 μm, the rustproof function of the oxide film (1*b*) against red rust is insufficient. When the film thickness exceeds 11 μm, the treatment time for forming the oxide film (1*b*) is long, or the treatment temperature is high, whereas when the film thickness is 5 μm to 11 μm, the rustproof action of the oxide film (1*b*) against red rust is sufficient, and the treatment time is short, or the treatment temperature is low.

To form the oxide film (1*b*) of triiron tetraoxide on the surface of the exhaust passage component (1) of ferrous metal, the exhaust passage component (1) of ferrous metal is treated in a steam atmosphere.

The oxide film (1*b*) of triiron tetraoxide has a thickness of more than 11 μm and not more than 20 μm.

The reason for that is as follows.

Like an industrial engine in which high-load operation continues for a long time, when the use conditions of the engine are severe and the rate of thermal deterioration of the oxide film (1*b*) due to combustion heat is high or the wear rate of the oxide film (1*b*) due to vibration is high, the service life of the oxide film (1*b*) may be insufficient with the film thickness being 11 μm or less. On the other hand, when the film thickness exceeds 20 μm, the processing time of the oxide film (1*b*) may exceed the allowable range for manufacturing efficiency, or the processing temperature may exceed the allowable range for protection of manufacturing equipment.

In contrast, in a case where the thickness of the oxide film (1*b*) of triiron tetraoxide is more than 11 μm and not more than 20 μm, even when the use conditions of the engine are severe, a sufficient service life can be obtained, the processing time is easily within the allowable range for manufacturing efficiency, and the processing temperature is also easily within the allowable range for protection of manufacturing equipment.

For the same reason as above, the lower limit of the film thickness may be set to 10 μm, and the range of the film thickness may be set to 10 μm to 20 μm.

In the above embodiment, the oxide film (1*b*) of triiron tetraoxide is formed on the surface of the exhaust passage component (1) which has not been subjected to the surface treatment, but may be formed on the surface of the exhaust passage component (1) which has been subjected to the surface treatment.

For example, an oxide film (1*b*) of triiron tetraoxide may be formed on the surface of the nitrogen compound layer of the exhaust passage component (1) obtained by the surface treatment of nitriding.

In this case, the following effects can be obtained.

The nitrogen compound layer can increase the hardness of the pressure receiving surface, and the oxide film (1*b*) prevents the nitrogen compound layer from softening due to denitrification, so that the fastening force of the fastener (2) does not easily decrease.

In the above embodiment, cast iron has been used as the ferrous metal to be the material of the exhaust passage component (1), but steel may be used.

Steel is used as a material of the fastener (2), the washer (2*d*), and each of the gaskets (3*c*), (4*d*), and (4*g*).

What is claimed is:

1. An exhaust system for an engine, comprising:

a supercharger having an exhaust turbine housing and an air compressor housing;

an intake pipe connected to the air compressor housing;

an exhaust relay pipe; and a cast-iron exhaust manifold having a collector, the collector including a plurality of exhaust inlet flanges and a single exhaust outlet flange;

wherein:

a direction of a crankshaft of the engine defines a front-to-rear direction, a lateral direction being oriented orthogonally to the front-to-rear direction, the plurality of exhaust inlet flanges being positioned along a lateral side of the collector and the exhaust outlet flange being positioned along a top side of the collector, the intake pipe, the air compressor housing, the exhaust turbine housing and the exhaust relay pipe being placed in line, above the collector, in order from front to rear, the exhaust outlet flange being positioned closer to a rear end of the collector than a front end of the collector, the exhaust turbine housing being fastened to the exhaust outlet flange;

the exhaust relay pipe being fastened to the collector rearward of the exhaust outlet flange; and the exhaust relay pipe being fastened to a rear of the exhaust turbine housing; and a screw fastener that fastens the exhaust turbine housing to the exhaust outlet flange, the exhaust outlet flange having an upper surface that includes a pressure receiving surface that receives a fastening force of the screw fastener, wherein an oxide film of triiron tetraoxide is formed on the pressure receiving surface, the oxide film being configured to resist plastic deformation by the fastening force of the screw fastener, thereby preventing the fastening force of the screw fastener from decreasing.

2. The exhaust system for an engine according to claim 1, wherein the oxide film of triiron tetraoxide is also formed on an outer surface other than the pressure receiving surface of the exhaust manifold.

3. The exhaust system for an engine according to claim 1, wherein the oxide film of triiron tetraoxide is also formed on an inner surface of the exhaust manifold.

4. The exhaust system for an engine according to claim 2, wherein the oxide film of triiron tetraoxide is also formed on an inner surface of the exhaust manifold.

5. The exhaust system for an engine according to claim 1, wherein the oxide film of triiron tetraoxide has a thickness of 5 μm to 11 μm.

6. The exhaust system for an engine according to claim 1, wherein the oxide film of triiron tetraoxide is formed on a surface of a nitrogen compound layer.

7. The exhaust system for an engine according to claim 1, wherein the oxide film of triiron tetraoxide has a thickness of more than 11 μm and not more than 20 μm.

8. The exhaust system for an engine according to claim 7, wherein the oxide film of triiron tetraoxide is formed on the surface of the nitrogen compound layer.

9. The exhaust system for an engine according to claim 1, wherein:

the screw fastener is a first screw fastener;

the exhaust relay pipe includes a mounting flange and the exhaust manifold includes a mounting seat disposed above the collector, the mounting flange of the exhaust relay pipe being fastened to an upper surface of the mounting seat via a second screw fastener;

the mounting seat has an upper surface that includes a pressure receiving surface that receives a fastening force of the second screw fastener, and an oxide film of triiron tetraoxide is formed on the pressure receiving surface of the mounting seat, the oxide film being configured to resist plastic deformation by the fastening force of the second screw fastener, thereby preventing the fastening force of the second screw fastener from decreasing.

10. The exhaust system for an engine according to claim 1, wherein the screw fastener is a first screw fastener, and the exhaust inlet flange is fastened a cylinder head via a second screw fastener;

the exhaust inlet flange having front and back surfaces that each include a pressure receiving surface that receives a fastening force of the second screw fastener, and wherein an oxide film of triiron tetraoxide is formed on the pressure receiving surface of each of the front and back surfaces of the exhaust inlet flange, the oxide film being configured to resist plastic deformation by the fastening force of the second screw fastener, thereby preventing the fastening force of the second screw fastener from decreasing.

* * * * *